US007848383B2

(12) United States Patent
Roberts et al.

(10) Patent No.: US 7,848,383 B2
(45) Date of Patent: Dec. 7, 2010

(54) COLD CRUCIBLE INDUCTION FURNACE WITH EDDY CURRENT DAMPING

(75) Inventors: Raymond J. Roberts, Moorestown, NJ (US); Graham A. Keough, Hainesport, NJ (US)

(73) Assignee: Consarc Corporation, Rancocas, NJ (US)

( * ) Notice: Subject to any disclaimer, the term of this patent is extended or adjusted under 35 U.S.C. 154(b) by 0 days.

(21) Appl. No.: 11/654,108

(22) Filed: Jan. 17, 2007

(65) Prior Publication Data

US 2007/0147463 A1 Jun. 28, 2007

Related U.S. Application Data

(62) Division of application No. 11/036,005, filed on Jan. 14, 2005, now Pat. No. 7,167,501.

(60) Provisional application No. 60/537,365, filed on Jan. 17, 2004.

(51) Int. Cl.
*H05B 6/02* (2006.01)

(52) U.S. Cl. ..... 373/147; 373/138

(58) Field of Classification Search ..... 373/147, 373/146, 148, 150, 151, 152, 156, 158, 138, 373/140, 142, 139; 219/632, 602, 647, 674, 219/634; 65/302

See application file for complete search history.

(56) References Cited

U.S. PATENT DOCUMENTS

| | | | | |
|---|---|---|---|---|
| 3,478,156 | A | 11/1969 | Segsworth | |
| 3,544,691 | A * | 12/1970 | Adamec | 373/146 |
| 5,109,389 | A | 4/1992 | Stenzel | |
| 5,901,169 | A | 5/1999 | Kobayashi | |
| 6,304,590 | B1 * | 10/2001 | Roberts | 373/138 |
| 2004/0136762 | A1 * | 7/2004 | Okayasu et al. | 399/329 |

* cited by examiner

*Primary Examiner*—Quang T Van
(74) *Attorney, Agent, or Firm*—Philip O. Post

(57) ABSTRACT

Apparatus and method are provided for damping the induced fluid flow, particularly in the region of the base plate, in an electrically conductive material that is heated and melted in a cold crucible induction furnace. Damping is accomplished by establishing a dc magnetic field such that flow of the electrically conductive liquid metal in that dc magnetic field would induce eddy currents in the liquid metal which would generate forces that tend to oppose the flow. The dc magnetic field may be established by dc current flow in the ac induction coil that induces current in the material, dc current flow in a separate dc coil, or coils, constructed to prevent excessive induced losses, by discrete magnets, or a combination of any of the three prior methods.

19 Claims, 8 Drawing Sheets

COLD CRUCIBLE INDUCTION FURNACE WITH EDDY CURRENT DAMPING

CROSS REFERENCE TO RELATED APPLICATIONS

This application is a divisional of U.S. application Ser. No. 11/036,005, filed Jan. 14, 2005, U.S. Pat. No. 7,167,501 which claims the benefit of U.S. Provisional Application No. 60/537,365, filed Jan. 17, 2004, both of which are hereby incorporated herein by reference in their entireties.

FIELD OF THE INVENTION

The present invention is in the technical field of melting electrically conductive materials, such as metals and alloys, by magnetic induction with a cold crucible induction furnace.

BACKGROUND OF THE INVENTION

A cold crucible induction furnace is used to melt and heat electrically conductive materials placed within the crucible by applying an alternating magnetic field to the materials. A common application of such furnace is the melting of a reactive metal or alloy, such as a titanium-based composition, in a controlled atmosphere or vacuum. FIG. 1(*a*) illustrates the principle features of a conventional cold crucible furnace. Referring to the figure, cold crucible 100 includes slotted wall 112. The interior of wall 112 is generally cylindrical. The upper portion of the wall may be somewhat conical to assist in the removal of skull as further described below. The wall is formed from a material that will not react with a hot metal charge in the crucible, when the crucible is fluid-cooled by conventional means. For a titanium-based charge, a fluid-cooled copper-based composition is suitable for wall 112. Slots 118 have a very small width (exaggerated for clarity in the figure), typically 0.005 to 0.125-inch, and may be closed with a heat resistant electrical insulating material, such as mica. Base 114 forms the bottom of the cold crucible. The base is typically formed from the same material as wall 112 and is also fluid-cooled by conventional means. The base is supported above bottom structural element 126 by support means 122 that may also be used as the feed and return for a cooling medium. A layer of heat resistant electrical insulation 124 (thickness exaggerated in the figure) may be used to separate the base from the sidewall. Induction coil 116 is wound around the exterior of wall 112 of the crucible, and is connected to a suitable ac power supply (not shown in the figure). When the supply is energized, current flows through coil 116 and an ac magnetic field is created within and external to the coil. The magnetic flux induces currents in wall 112, base 114 and the metal charge placed inside the cold crucible. Flux penetration into the interior of the crucible is assisted by slots 118. Heat generated by the induced currents in the charge melts the charge. As illustrated by furnace 100 in partial detail in FIG. 1(*b*), a portion of metal charge adjacent to the cooled wall and base freezes to form skull 190 around liquid metal 192. The skull acts as a partial container for the molten metal, and the upper regions of the molten metal are at least partially supported by the Lorentz forces generated by the interaction of the magnetic field produced by coil 116 and the induced currents in the metal charge, to form a region of reduced contact pressure or even separation 194 between the wall and the liquid metal. Such reduced contact pressure or separation is important in reducing the thermal losses from the hot charge to the cold crucible. The Lorentz forces also cause the liquid metal to be vigorously stirred. After removal of the liquid metal product from the crucible, the skull can be left in place for a subsequent melt, or removed from the crucible, as desired.

As mentioned above, liquid metal in the crucible above the skull is generally kept away from the crucible's wall by Lorentz forces acting on the mass of liquid metal. Fluid motions caused by induced currents can intermittently disturb the region of separation between the wall and the mass of liquid metal. Such disturbances increase the boundary area of the melt, resulting in increased heat radiation losses from the liquid, or even increased conduction losses, if some of the liquid metal washes or splashes against the wall of the crucible.

It is sometimes desirable to superheat the liquid metal, for example to make it more fluid and therefore, more suitable for casting into a mold to form a casting having thin sections. However, the above apparatus and method has disadvantages when used to superheat the liquid metal. With increased superheat, there is an increased temperature difference between the liquid metal (melt) and the skull. This results in an increase in the heat transferred from the liquid metal to the skull. Consequently a portion of the formed skull melts back to liquid metal, which reduces the thickness of the skull. Decreased skull thickness increases heat losses from the liquid melt. Further the skull may be reduced in overall volume, so that parts of the liquid melt formerly contained within the skull can come into contact with the wall of the crucible, which greatly increases the heat loss from the liquid metal. In practice, the result is that for any reasonable power input to the above apparatus and process, the superheat is severely limited.

V. Bojarevics and K. Pericleous, *Modelling Induction Skull Melting Design Modifications, Journal of Materials Science: Special Section: Proceedings of the* 2003 *International Symposium on Liquid Metals*, Vol. 39, no. 24 (December 2004), pp 7245-7251 (presented on 23 Sep. 2003 in Nancy, France), suggests locating a separate dc coil adjacent to the ac coil of a cold crucible arrangement (paragraph beginning at the bottom right-hand column on page 7248 and continuing on page 7249 page 4 of the Bojarevics and Pericleous paper); i.e. towards the bottom part of the crucible and below the ac coil. DC current flowing through the dc coil creates a dc magnetic field that is superimposed on the ac field. When the molten charge, driven by the Lorentz forces previously described, moves across the field lines of the dc field, additional currents are induced in the moving metal. Such currents react with the dc flux to produce a braking action that reduces the fluid velocity. Such braking action is well known and is often referred to as eddy current braking or eddy current damping. By reducing the metal flow velocity, such damping reduces the turbulence in the liquid metal near the bottom of the cold crucible, thereby reducing the heat convectively transferred from the liquid metal into the skull; thereby permitting significantly increased superheat for a given power input. Such use of a dc magnetic field for eddy current damping or braking of moving metal in an induction coil is known prior art (see e.g. U.S. Pat. No. 5,003,551). However, locating a dc coil adjacent to the ac coil as proposed in the Bojarevics and Pericleous paper, would result in the ac magnetic field inducing high losses in the large cross sectional dc conductors shown in the paper. Moreover, there is no recognition or analysis of this deleterious effect in the Bojarevics and Pericleous paper. Nor can this problem be alleviated by simply moving the dc coil away from the ac coil, or vice versa, because the magnetic field of a coil so moved would be reduced in the crucible's interior space, thus rendering the moved coil less effective.

Therefore, there exists the need for apparatus and a method of induction melting an electrically conductive material with a cold crucible wherein convective heat loss to the cold crucible is limited, in order to obtain more superheat.

BRIEF SUMMARY OF THE INVENTION

In one aspect, the invention is apparatus and method for induction melting of an electrically conductive material in a cold crucible induction furnace wherein a dc field is established to selectively decrease motion in the molten material. Induction melting is achieved by ac current flow in an ac coil surrounding the cold crucible. The dc field may alternatively, or in selective combinations, be established: by the flow of dc current in the ac coil; in a shielded dc coil separate from the induction coil; or by magnets selectively disposed around the exterior of the wall of the crucible.

In other examples of the invention the dc field is established by the flow of dc current in a dc coil disposed below the cold crucible. The coil contains a magnetic pole piece in which the magnetic field is concentrated and directed into the bottom of the cold crucible. Optionally one or more dc coils may be provided between the ac coil and the dc coil around the outside of the cold crucible, to further assist in selectively decreasing motion in the molten material.

These and other aspects of the invention are further set forth in this specification and the appended claims.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 1(*b*) is a cross sectional elevation of a formed skull and liquid metal in a conventional cold crucible induction furnace.

DETAILED DESCRIPTION OF THE INVENTION

Figure 1A:
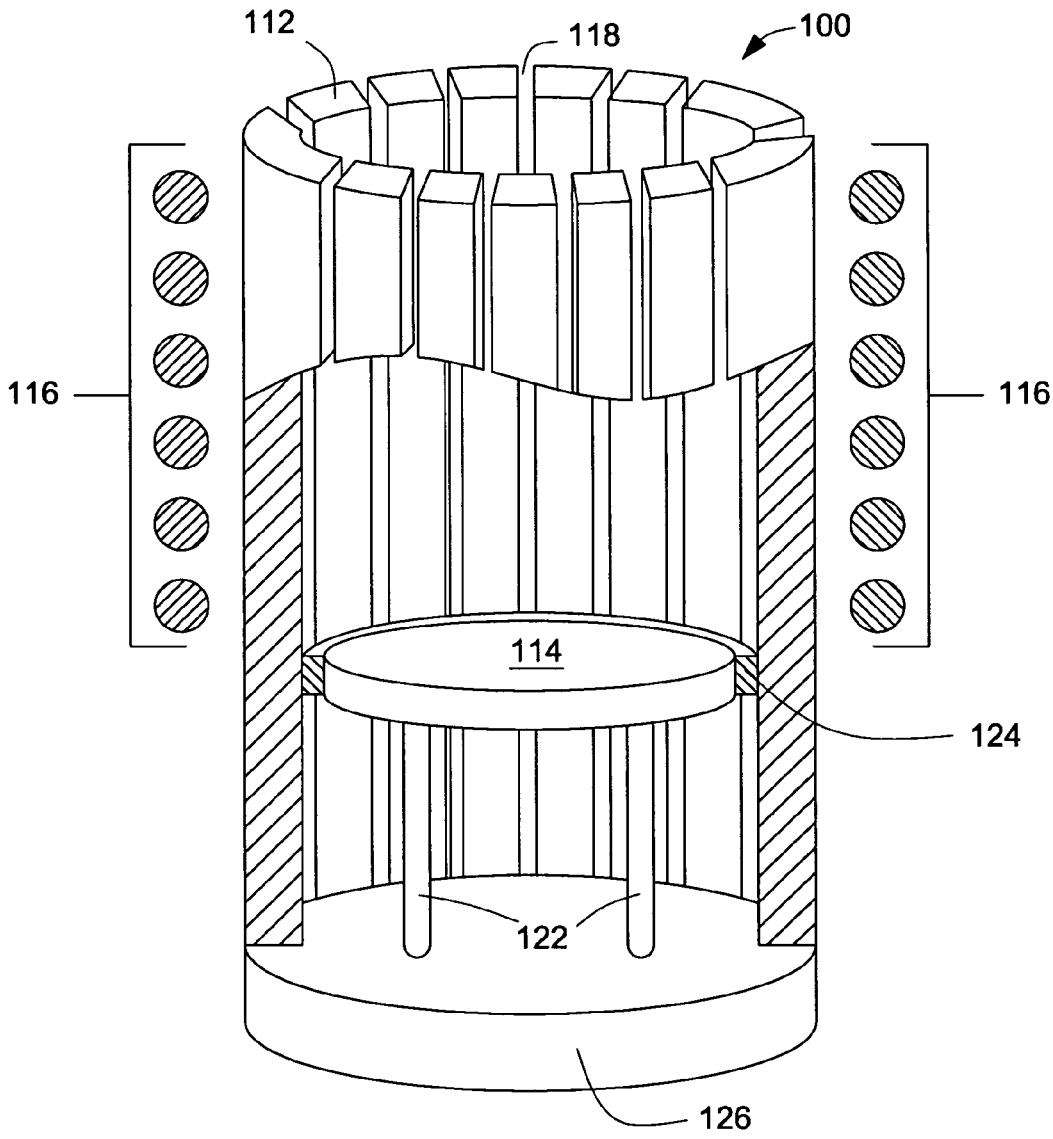
FIG. 1(a) PRIOR ART
FIG. 1(*a*) is a partial cross sectional elevation of a conventional cold crucible induction furnace.
Figure 1B:
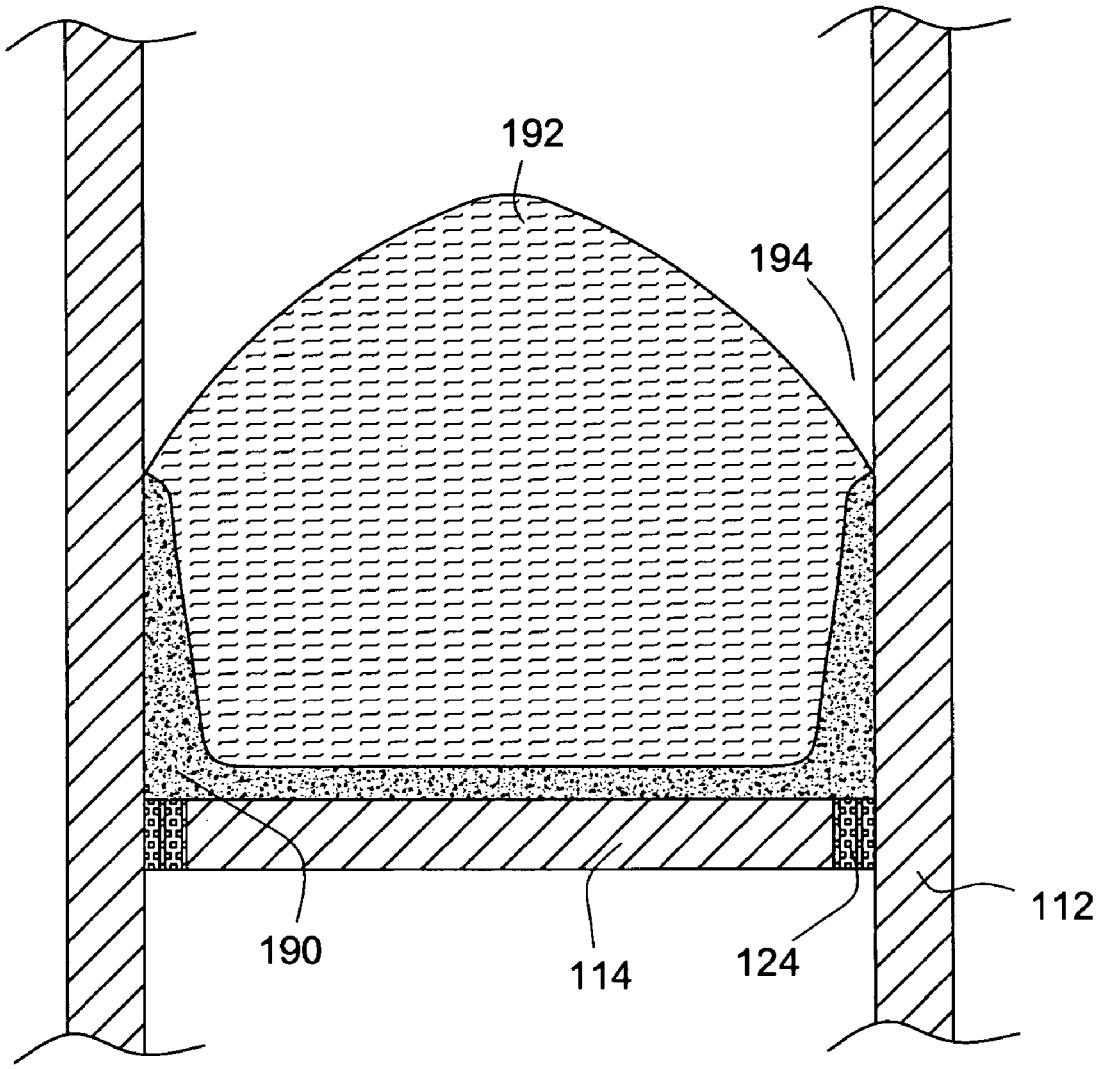
FIG. 1(b) PRIOR ART
Figure 2:
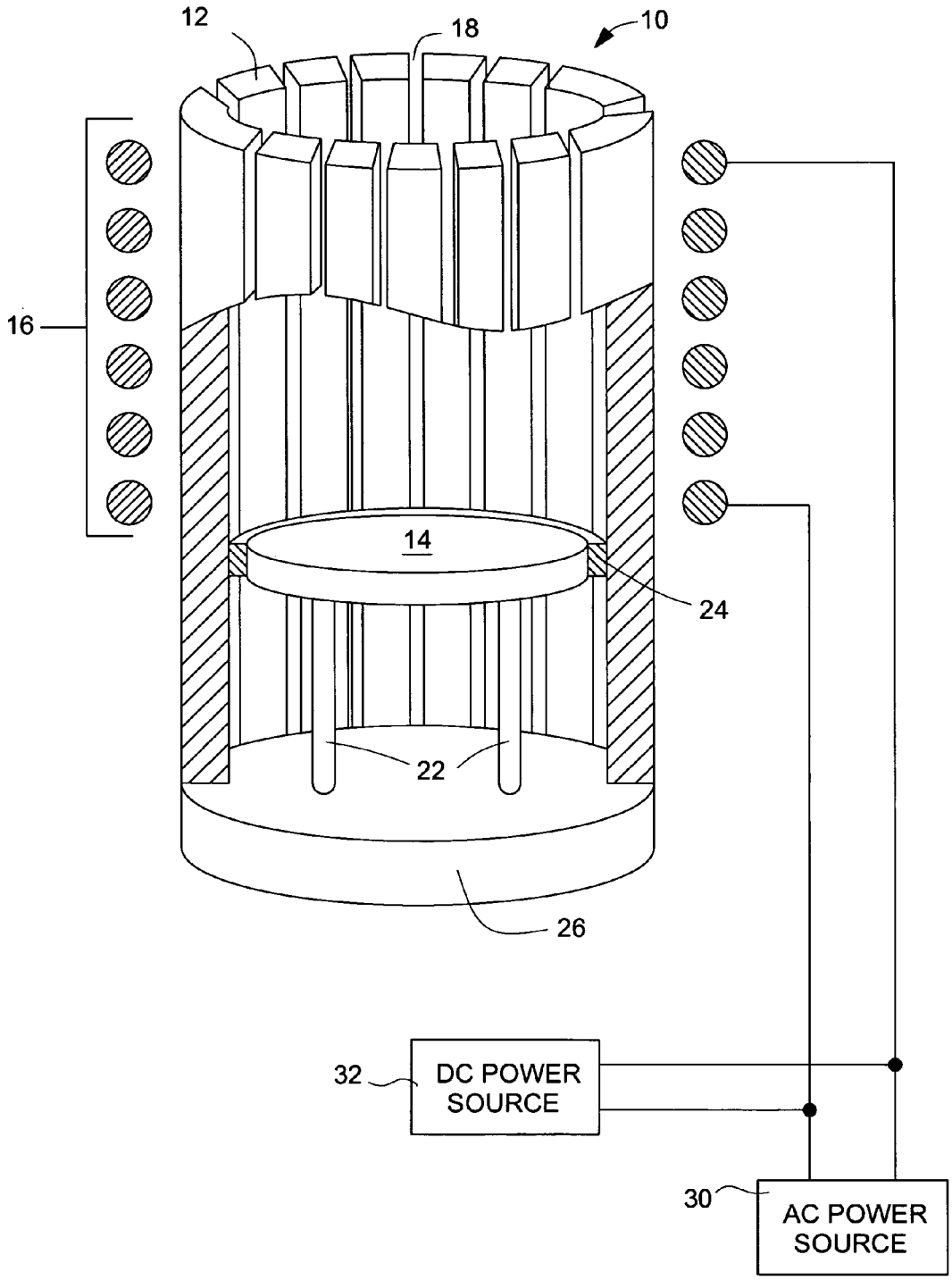
FIG. 2 is a partial cross sectional elevation of one example of the cold crucible induction furnace with eddy current damping of the present invention wherein eddy current damping is provided by the flow of dc current in the induction coil that carries ac current for inductive current heating of an electrically conductive material placed in the crucible.

As used in this specification, the term "induced currents" generally refers to currents induced by an ac coil and the term "eddy currents" generally refers to currents generated by the movement of molten electrically conductive material across dc field lines. There is shown in FIG. 2, one example of a cold crucible induction furnace 10, with eddy current damping, of the present invention. For this example crucible 10 may comprise a cold crucible with wall 12 having slots 18, and base 14. The base may be separated from the wall by a layer of thermal and electrical insulation 24. The base may be raised above bottom structural support element 26 by suitable support means 22. Induction coil 16 is wound at least partially around the height of wall 12. Induction coil 16 is suitably connected to ac power source 30. AC current provided from the ac power source flows through coil 16 and establishes an ac field that penetrates into wall 12 and an electrically conductive material placed within the crucible. By example, and not limitation, the electrically conductive material may be a metal or alloy. The ac field couples with the metal and induces currents in the metal that heats the metal to a liquid state. The output of dc power source 32 is connected in parallel with the output of the ac power source. DC current provided from the dc power source flows through coil 16 and establishes a dc field that penetrates into wall 12, base 14 and the liquid metal in the crucible. The dc field dampens the fluid flow induced in the melt by the ac field. Heat loss from the liquid metal to the skull takes place principally by a process of forced convection that is set up by the Lorentz-force driven molten metal flowing adjacent to the interior surfaces of the skull. This convective heat loss is reduced when the fluid velocity is reduced by the eddy current braking action of the dc field. Consequently, selectively controlling the magnitude of the dc field by controlling the magnitude of the dc current from dc power source 32 during the heating and melting process can be used to selectively reduce heat loss during the heating and melting process.

Suitable impedance elements can be provided at the output of the ac and dc power supplies to prevent current feedback from one supply to the other supply. In the example shown in FIG. 2 only a single induction coil is used. In other examples of the invention two or more induction coils may be used to surround different regions along the height of the crucible, and one or more ac and dc power supplies may be selectively connected to one or more of the multiple induction coils depending upon whether a particular region requires dc field damping. In examples of the invention wherein more than one induction coil is provided, the one or more dc power supplies may be selectively applied to less than the total number of induction coils.

Figure 3:
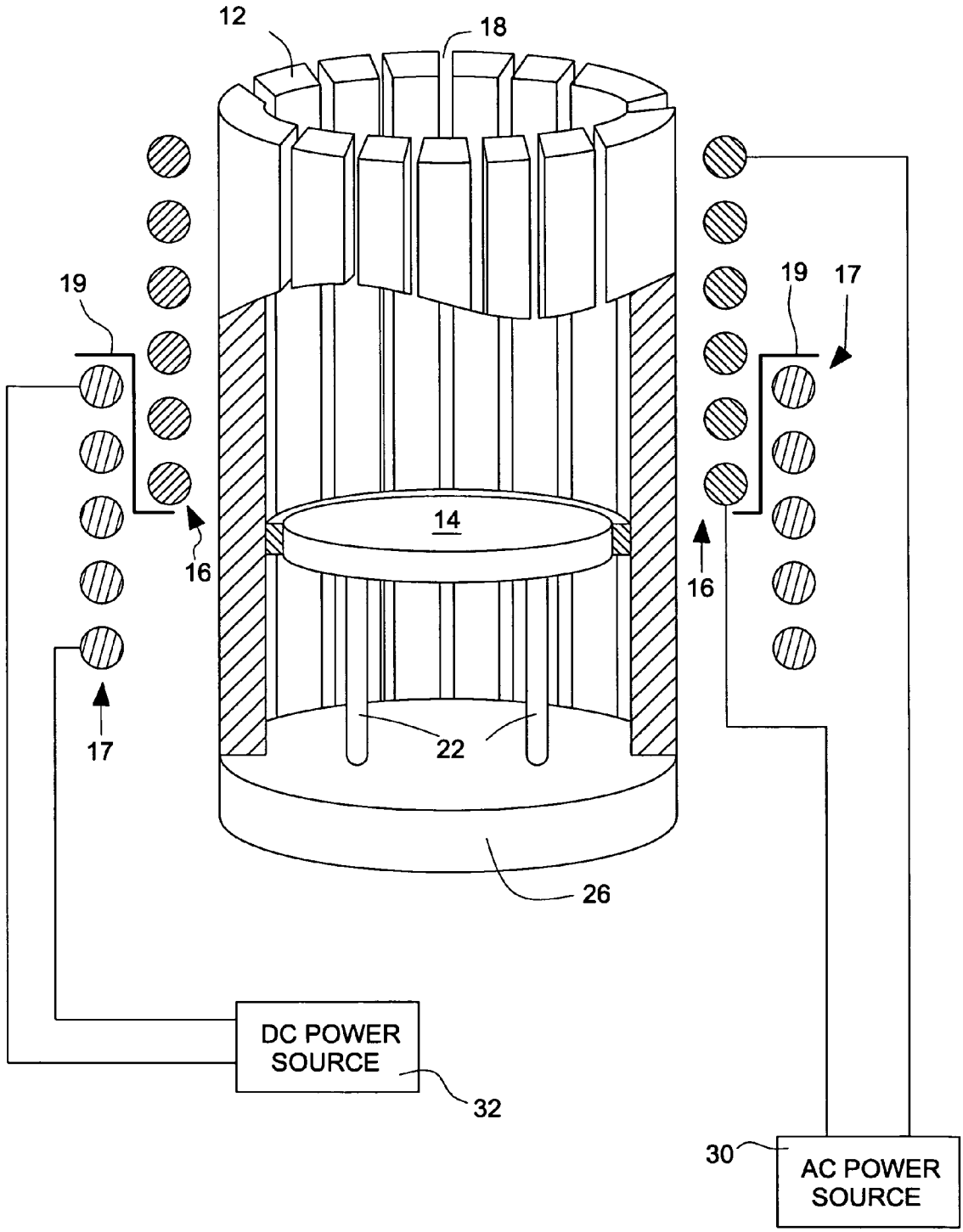
FIG. 3 is a partial cross sectional elevation of one example of the cold crucible induction furnace with eddy current damping of the present invention wherein eddy current damping is provided by the flow of dc current in a dc field coil that is separate from the induction coil that carries ac current for inductive current heating of an electrically conductive material placed in the crucible.

In other examples of the invention one or more dc field coils are provided separate from one or more ac current induction coils around the outer wall of the crucible. In the non-limiting example of the invention shown in FIG. 3, dc field coil 17 is wound around the exterior of wound induction coil 16. AC power source 30 supplies ac current to induction coil 16 to melt and/or heat an electrically conductive material placed inside the crucible by magnetic induction of currents in the material as described above. DC power supply 32 supplies dc current to dc field coil 17 to selectively dampen fluid flow in the material. Shield 19 can be optionally provided to shield the dc field coil from the ac field produced by induction coil. The shield can be fabricated from a suitable material with high electrical conductivity. Alternatively, the one or more dc field coils may be interspaced with the one or more induction coils in substantially vertical alignment. Another non-limiting arrangement is providing one or more helically wound dc field coils below base 14 of the crucible. This concentrates the established dc field near the bottom of the melt in the crucible, where damping is most needed, to reduce forced convection heat losses to the skull. In all cases in which a separate dc coil is used, excessive induced losses in the dc coil conductors are prevented by some combination of shielding, coil location or the use of multiple, insulated small cross section conductors to carry the dc current.

In the above examples of the invention wherein a variable dc current is used to provide variable eddy current damping, one non-limiting method of the invention is to start with zero or low magnitude dc current early in the melting process when vigorous induced current stirring of the melt is desired to dissolve charge material (such as the skull from a prior melt) with a high melting temperature. As charge is melted the magnitude of dc current can be increased, maximum dc current being used when the charge is completely melted and the goal is to maximize superheat in preparation for transferring the liquid metal to a mold or other container.

Figure 4:
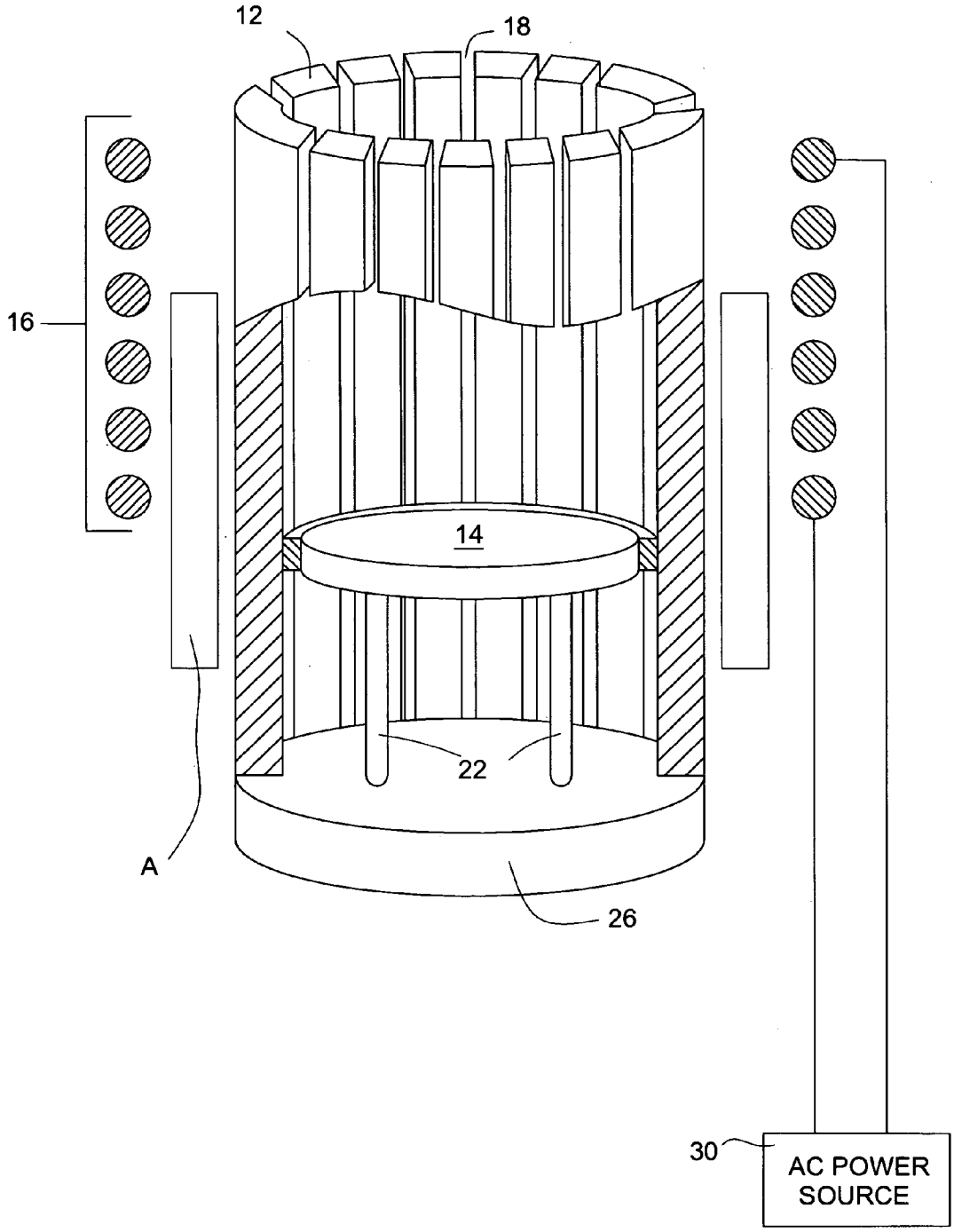
FIG. 4 is a partial cross sectional elevation of one example of the cold crucible induction furnace with eddy current damping of the present invention wherein eddy current damping is provided by one or more magnets disposed around the exterior of the wall of the furnace.

In other examples of the invention one or more discrete permanent magnets may disposed around the outer perimeter of slotted wall 12 of the furnace, generally in a cylindrical region identified as region A in FIG. 4, and/or in a region under base 14 (not illustrated in the drawing). A plurality of discrete magnets, each with a particular magnitude of dc field strength and geometry that is dependent upon their placement around the crucible may be used. Means must be provided to prevent overheating of the magnets caused by magnetic coupling with the ac field established by ac current flow through induction coil 16. Such means may include siting of the magnet in minimum ac field regions; magnetically shielding the magnet from the ac fields; and/or composing the magnet from electrically isolated segmented elements. Use of permanent magnets provides less flexible eddy current control than a variable dc field established by variable dc current in the above examples of the invention. Alternatively discrete electromagnets may be used to vary the dc field of the magnet, and, in turn, vary the eddy current damping.

In other examples of the invention, eddy current damping may be accomplished by a selective combination of two or three of the previously disclosed methods, namely: dc current flow in the induction coil; dc current flow in a dc field coil separate from the ac coil; and permanent magnets or electromagnets.

Other arrangements of combined ac and dc current coils, separate ac induction coils and dc field coils, and magnets are contemplated as being within the scope of the invention as long as the established dc fields are used to damp the fluid flows induced in the electrically conductive material in the crucible, in order to increase superheat, without incurring excessive induced losses in the components that are being used to generate the dc field.

Figure 5:
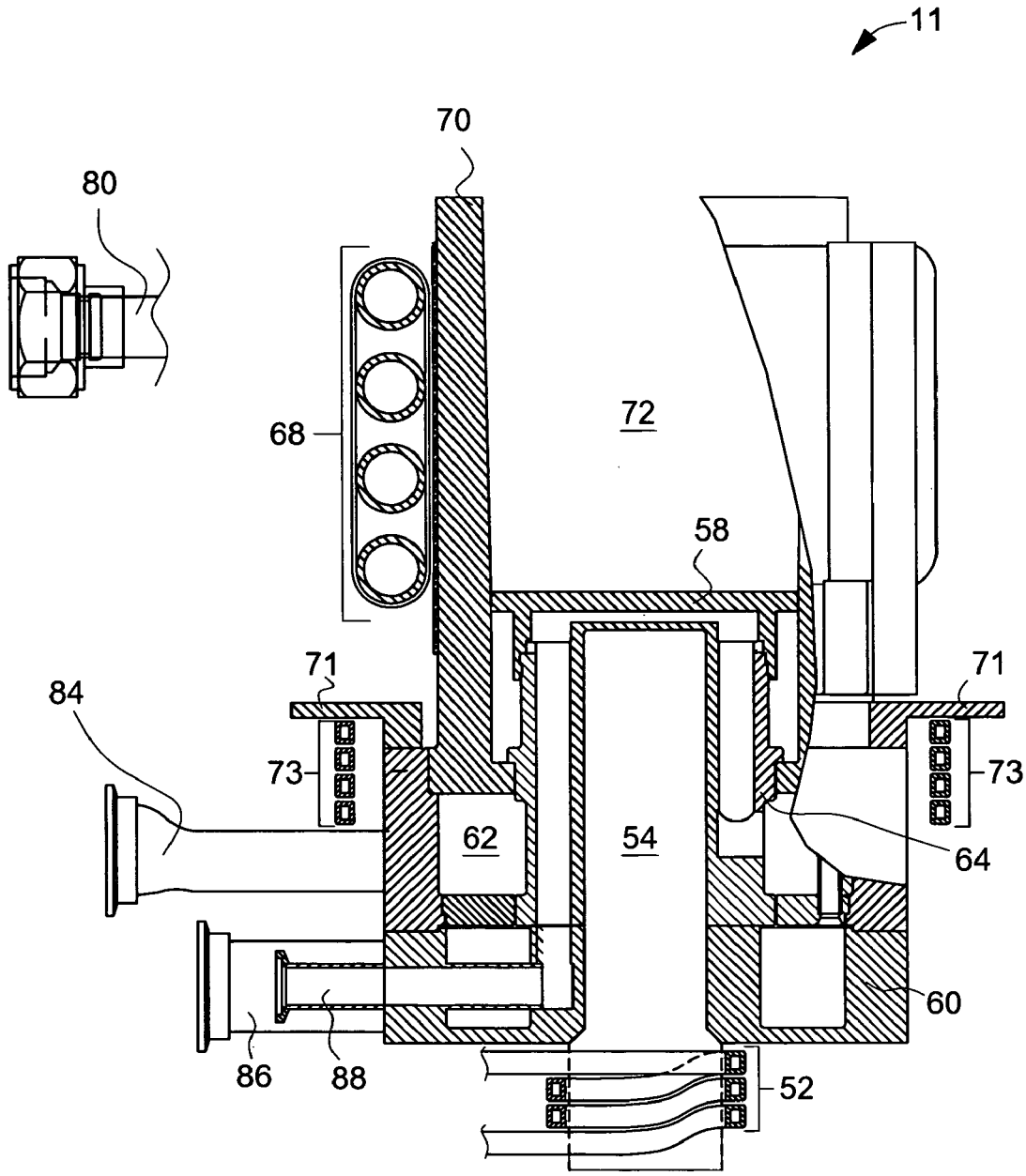
FIG. 5 is a partial cross sectional elevation of another example of the cold crucible induction furnace with eddy current damping of the present invention.

There is shown in FIG. 5, another example of a cold crucible induction furnace, with eddy current damping, of the present invention. Furnace 11 has a first dc coil 52 wound around a first end section of magnetic pole piece 54. In other examples of the invention the first dc coil can be wound around other regions of the magnetic pole piece; further more than one first dc coils may be provided. First dc coil 52 can be, but is not limited to, hollow electrical conductors wherein the interior passage is used for the flow of a cooling medium. Magnetic pole piece 54 is formed from a suitable soft magnetic material, such as high purity iron. One non-limiting shape for the magnetic pole piece is a substantially solid cylinder, although other shapes can be used to concentrate the dc magnetic field generated around the first dc coil. A magnetic pole piece flange (not shown in the figure) can be attached to the first end of the magnetic pole piece to serve as a means for holding the first dc coil in place and to control the shape of the dc magnetic field. Magnetic pole piece 54 protrudes into the base of the furnace as shown in FIG. 5 so that the second end of the pole piece is adjacent to the crucible base plate 58. An optional second dc coil 73 is wound around the exterior of the base of the furnace in a location between crucible base plate 58 and bottom structural support or stool plate 60. Second dc coil 73 may be of the same or similar construction as the first dc coil.

Support 64 provides a means for supporting base plate 58 and the weight of the metal in the melting chamber 72. Coolant jacket 62 provides a means for supporting and supplying coolant to segmented furnace wall 70 and base 58. In this non-limiting example of the invention each of the segments making up the furnace wall has an interior chamber for the passage of a cooling medium, such as water. AC induction coil 68 is shown only on the left side of the furnace in FIG. 5 since the coil insulation on the right side of the furnace in this partial cross sectional figure encloses the ac induction coil. In this non-limiting example of the invention, induction coil water inlet 80 supplies current and cooling water to hollow induction coil 68; water and current exit the coil through an induction coil water outlet not shown in the figure.

Induction coil 68 at least partially surrounds the melting chamber of the furnace and inductively heats an electrically conductive charge placed within the melting chamber when an ac current (provided by a suitable power supply not shown in the figures) flows through the induction coil. DC current flowing through first dc coil 52 from one or more suitable dc power supplies (not shown in the figures), generates a dc field that is concentrated in the magnetic pole piece 54. The second end of the pole piece is arranged to be adjacent to crucible base plate 58 so that the dc field penetrates predominantly into the bottom and lower sides of melting chamber 72 to decrease the flow intensity and turbulence of the liquid adjacent to the base in the melting chamber that is caused by the induced ac currents in the charge. The shape and location of pole piece 54 and the location of first dc coil 52 cause the various components of the crucible assembly to shield dc pole piece 54 and first dc coil 52 from the ac fields produced by the induction coil.

Optional second dc coil 73 may be used to minimize the loss of dc magnetic flux from the sides of pole piece 54 and further enhance the flux density (magnetic field strength) at the top of pole piece 54 below base plate 58. Such optional second dc coil 73 may be separately shielded from the ac field produced by induction coil 68 by coil shield 71 that is composed substantially of a material with high electrical conductivity. The currents induced in this shield by the magnetic field from ac coil 68 serve to redirect the ac field, reducing the magnitude of the currents induced in the conductors of second dc coil 73.

Water inlet 84 provides cooling water to the interior passages in the segments of wall 70 and baseplate 58. Water outlet 86 provides a return for cooling water from the interior passages in the segments of wall 70; water outlet 88 provides a return for cooling water from the interior passages in base 58.

Figure 6:
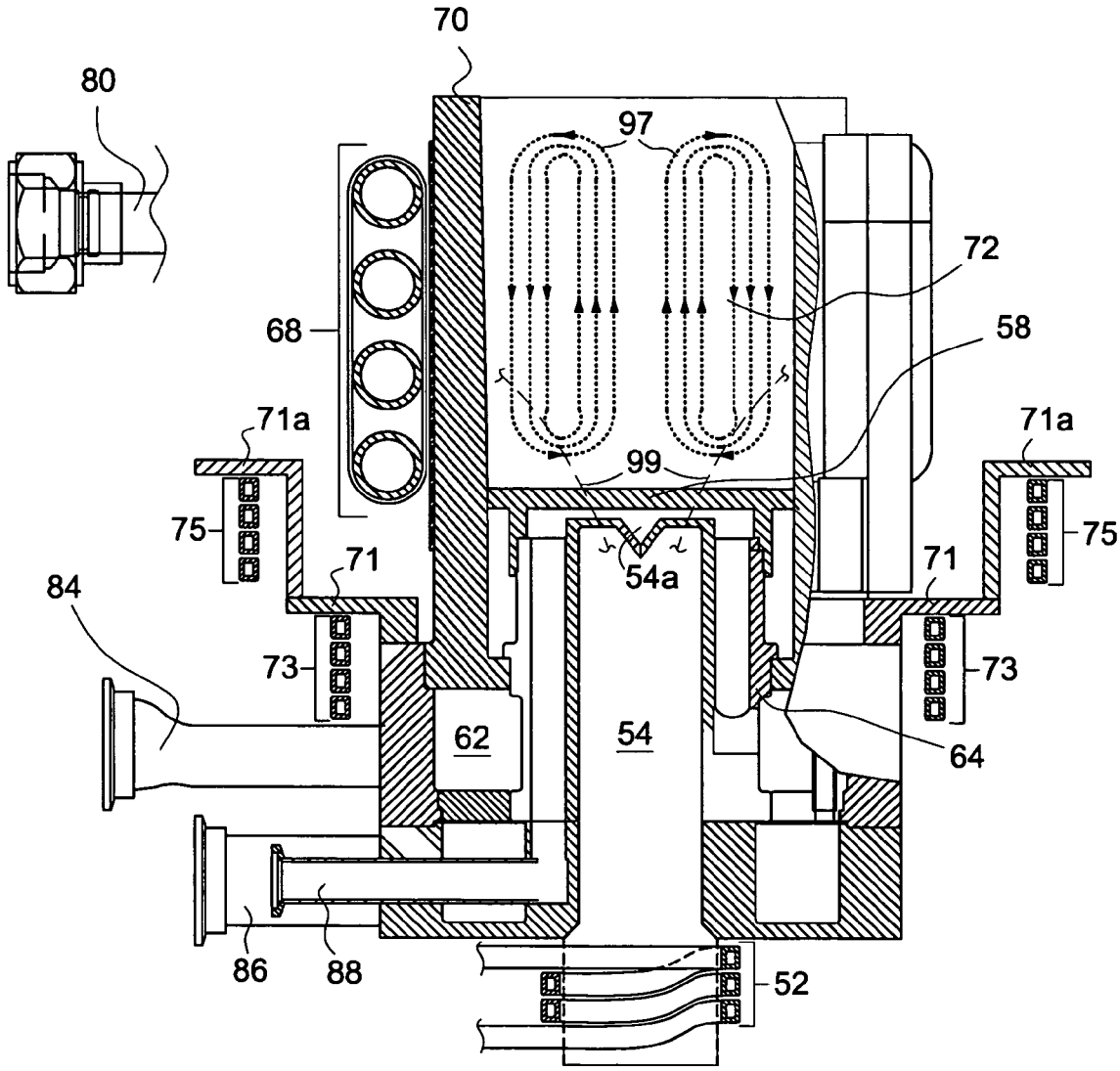
FIG. 6 is a partial cross sectional elevation of another example of the cold crucible induction furnace with eddy current damping of the present invention.

FIG. 6 illustrates another example of a cold crucible induction furnace, with eddy current damping, of the present invention. In this example of the invention the top of magnetic pole piece 54 is shaped to concentrate dc field penetration away from the center of crucible base plate 58 as illustrated by typical dc flux lines (shown as dashed lines 99 in the figure). The advantage of this arrangement is that the dc field is concentrated in regions in which the electromagnetically induced flow of molten metal in the melting chamber (generally represented by dotted lines 97 in the figure) has the maximum flow velocity across the dc field lines, thereby improving the eddy current braking effect of the dc field, to further reduce the convective heat loss to the skull. The shaping of the top of the pole piece in FIG. 6 illustrates one non-limiting arrangement of achieving this advantage. In the figure magnetic pole piece 54 is of substantially solid cylindrical shape, and has a conical open volume 54*a* formed at the center of its top, which concentrates the dc field near the mid-radius of the crucible base.

Also shown in FIG. 6 is optional third dc coil 75 which is disposed above and further away from wall 70 than optional second dc coil 73. The advantage of the optional third dc coil, which can be used in any example of the invention wherein the optional second dc coil is used, is to further enhance the dc field in the region just above the crucible base. Coil shield 71*a* performs a function similar to that of coil shield 71 as previously described above.

In other examples of the invention the first dc coil 52 in FIG. 6 is not used while second dc coil 73 and third dc coil dc coil 75 are used to establish a dc field that is concentrated in magnetic pole piece 54 and penetrates predominately into the bottom and lower sides of the melting chamber. All other features and options of theses examples of the invention are generally the same as those shown in FIG. 6 and described above.

Figure 7:
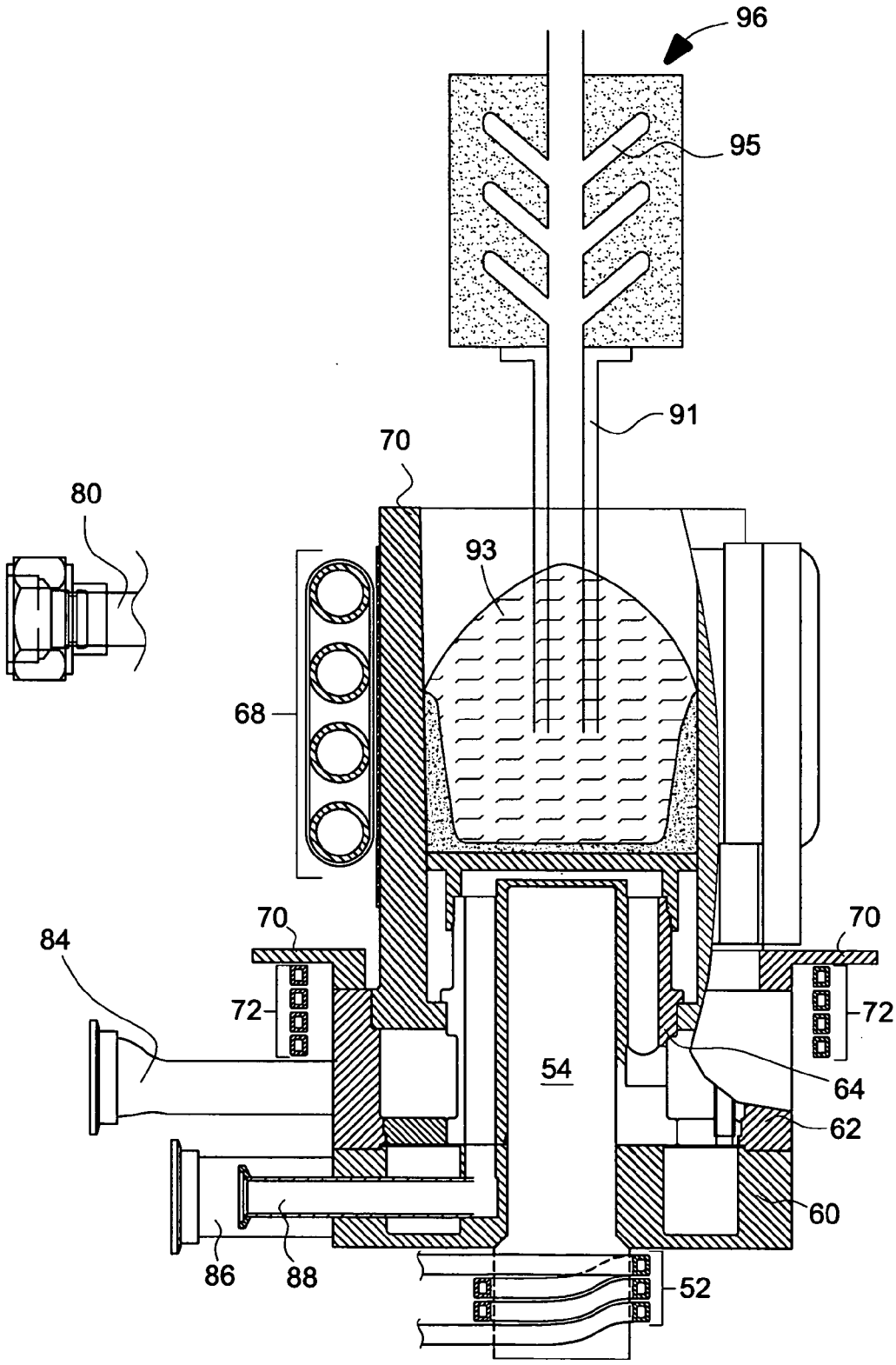
FIG. 7 is a partial cross sectional elevation of another example of the cold crucible induction furnace with eddy current damping of the present invention, arranged to provide a counter gravity casting process.

Once the electrically conductive material, such as a liquid metal, has been melted in the melting chamber by induction heating, various methods can be used to remove the liquid metal from the chamber. For example, the melting chamber may be mounted on a support structure providing a means for tilting of the melting chamber and pouring of the liquid metal into a suitable container such as a mold. Another non-limiting method of removing the liquid metal from the melting chamber for the cold crucible induction furnace of the present invention is by a process known as counter-gravity casting of molten metals. U.S. Pat. No. 4,791,977 generally describes the process of counter-gravity casting and is hereby incorporated herein by reference in its entirety. Referring to FIG. 7, in this process the lower portion of fill pipe 91 is inserted into the molten metal 93 in the melting chamber. The fill pipe is removably connected to the interior cavity 95 in mold 96. A reduced pressure is applied to the interior cavity of the mold as further described in U.S. Pat. No. 4,791,977 to draw molten metal from the melting chamber through the fill pipe and up into the interior cavity of the mold until the mold is filled. The applied dc field in the present invention may be used to increase the superheat of the metal to enhance the filling of the cavities of the mold.

Alternatively in all examples of the invention any of the dc coils may comprise a suitable arrangement of a plurality of small cross sectional insulated conductors to prevent overheating of the dc coils.

The above examples of the invention utilize one magnetic pole piece. Two or more pole pieces suitably arranged are contemplated as being within the scope of the invention.

The foregoing examples do not limit the scope of the disclosed invention. The scope of the disclosed invention is further set forth in the appended claims.

The invention claimed is:

1. A cold crucible induction furnace for heating an electrically conductive material, the furnace comprising:

a wall and a base to form a melting chamber in which the electrically conductive material is contained;

at least one ac induction coil at least partially surrounding the height of the wall;

an ac power source having its output connected to the at least one ac induction coil to supply ac power to the at least one ac induction coil and generate an ac field around the at least one ac induction coil, the ac field magnetically coupling with the electrically conductive material to inductively heat and at least partially melt the electrically conductive material by inducing currents in the electrically conductive material;

at least one dc coil at least partially surrounding the height of the wall, the at least one dc coil wound at least partially around the exterior of the at least one ac induction coil; and a dc power source having its output connected to the at least one dc coil to supply dc power to the at least one dc coil and to generate a dc field, the dc field damping the induced flows in the molten portions of the electrically conductive material.

2. The cold crucible induction furnace of claim 1 further comprising one or more shields to shield the at least one dc coil from the ac field.

3. The cold crucible induction furnace of claim 1 wherein the at least one dc coil comprises a plurality of small cross sectional insulated conductors.

4. The cold crucible induction furnace of claim 1 further comprising one or more magnets selectively disposed around the melting chamber to damp the induced flows in the molten portions of the electrically conductive material.

5. The cold crucible induction furnace of claim 4 wherein the one or more magnets are permanent or electro magnets.

6. The cold crucible induction furnace of claim 4 further comprising a means to prevent overheating of the one or more magnets from magnetic coupling with the ac field.

7. The cold crucible induction furnace of claim 4 wherein the one or more magnets are at least selectively disposed around the outside of the wall.

8. The cold crucible induction furnace of claim 4 wherein the one or more permanent magnets are at least selectively disposed below the base.

9. A cold crucible induction furnace for heating an electrically conductive material, the furnace comprising:

a wall and a base to form a melting chamber in which the electrically conductive material is contained;

at least one ac induction coil at least partially surrounding the height of the wall;

an ac power source having its output connected to the at least one ac induction coil to supply ac power to the at least one ac induction coil and generate an ac field around the at least one ac induction coil, the ac field magnetically coupling with the electrically conductive material to inductively heat and at least partially melt the electrically conductive material by inducing currents in the electrically conductive material;

at least one dc coil at least partially surrounding the height of the wall, the at least one dc coil at least partially interspaced with the at least one ac induction coil in substantially vertical alignment to prevent induced current heating of the at least one dc coil; and a dc power source having its output connected to the at least one dc coil to supply dc power to the at least one dc coil and to generate a dc field, the dc field damping the induced flows in the molten portions of the electrically conductive material.

10. The cold crucible induction furnace of claim 9 further comprising one or more shields to shield the at least one dc coil from the ac field.

11. The cold crucible induction furnace of claim 9 wherein the at least one dc coil comprises a plurality of small cross sectional insulated conductors.

12. The cold crucible induction furnace of claim 9 further comprising one or more magnets selectively disposed around the melting chamber to damp the induced flows in the molten portions of the electrically conductive material.

13. The cold crucible induction furnace of claim 12 wherein the one or more magnets are permanent or electro magnets.

14. The cold crucible induction furnace of claim 12 further comprising a means to prevent overheating of the one or more magnets from magnetic coupling with the ac field.

15. The cold crucible induction furnace of claim 12 wherein the one or more magnets are at least selectively disposed around the outside of the wall.

16. The cold crucible induction furnace of claim 12 wherein the one or more permanent magnets are at least selectively disposed below the base.

17. A method of heating an electrically conductive material in a cold crucible, the method comprising the steps of:

placing the electrically conductive material in the cold crucible;

melting at least a part of the electrically conductive material by generating an ac magnetic field for coupling with the electrically conductive material by the flow of ac current through at least one ac induction coil at least partially surrounding the wall of the cold crucible; and damping the induced flows in the molten portions of the electrically conductive material by a dc magnetic field generated by supplying dc current to an at least one dc coil at least partially surrounding the wall of the cold crucible, the at least one dc coil at least partially interspaced with the at least one ac induction coil.

18. The method of claim 17 further comprising the step of damping the induced flows in the molten portions of the electrically conductive material by one or more magnets disposed around the exterior of the cold crucible.

19. The method of claim 18 further comprising the step of progressively increasing the magnitude of dc current to a winding associated with at least one of the one or more magnets to form an electro magnet as the mass of electrically conductive material in the molten state increases.

* * * * *